US006622432B2

(12) United States Patent
Zacher et al.

(10) Patent No.: US 6,622,432 B2
(45) Date of Patent: Sep. 23, 2003

(54) EXTERIOR DOOR WITH OVERLAYS FOR SEALING A GAP BETWEEN THE DOOR AND A DOORFRAME

(75) Inventors: Bryan P. Zacher, Brookings, SD (US); Allen E. Lee, Brookings, SD (US)

(73) Assignee: Larson Manufacturing Company, Brookings, SD (US)

( * ) Notice: Subject to any disclaimer, the term of this patent is extended or adjusted under 35 U.S.C. 154(b) by 0 days.

(21) Appl. No.: 09/804,384

(22) Filed: Mar. 12, 2001

(65) Prior Publication Data

US 2002/0124470 A1 Sep. 12, 2002

(51) Int. Cl.[7] ..... E06B 3/00
(52) U.S. Cl. ..... 49/501; 49/401
(58) Field of Search ..... 49/383, 400, 401, 49/476.1, 402, 501, 490.1; 52/800.13, 717.01

(56) References Cited

U.S. PATENT DOCUMENTS

| | | | | | |
|---|---|---|---|---|---|
| 1,706,546 | A | * | 3/1929 | Rockwell | 49/401 |
| 2,853,541 | A | * | 9/1958 | Lindgren | 174/35 MS |
| 2,908,947 | A | * | 10/1959 | Meacham | 49/401 |
| 3,164,869 | A | * | 1/1965 | Barkan | 220/592.06 |
| 3,358,402 | A | * | 12/1967 | Sahm | 49/401 |
| 3,426,482 | A | * | 2/1969 | Mock | 49/401 |
| 3,796,008 | A | * | 3/1974 | Eakin | 49/380 |
| 4,064,655 | A | * | 12/1977 | Weyant | 49/501 |
| 4,223,499 | A | * | 9/1980 | Schrunk | 428/38 |
| 4,290,233 | A | * | 9/1981 | Hubbard | 49/383 |
| D305,067 | S | | 12/1989 | Borgen | |
| D327,527 | S | | 6/1992 | Walker et al. | |
| 5,230,180 | A | * | 7/1993 | Tweedt et al. | 49/400 |
| 5,546,714 | A | | 8/1996 | Kenkel | |
| 5,711,706 | A | * | 1/1998 | Griffin et al. | 454/338 |
| 5,887,391 | A | | 3/1999 | Shoup | |
| 5,894,706 | A | | 4/1999 | Herbst | |
| D418,608 | S | | 1/2000 | Witte et al. | |
| 6,088,966 | A | * | 7/2000 | Kenkel | 49/383 |

OTHER PUBLICATIONS

EMCO Specialities, Inc., Maxxview Series, Forever ®Storm/Screen Doors, © 1997, P.O. Box 853, Des Moines, Iowa 50304.

Chamberdoor Industries, Inc., ChamberDoor Woodcore Line, published more than a year before the filing date of the present application, 153 Extrusion Place, Hot Springs, Arkansas 71901.

* cited by examiner

*Primary Examiner*—Gregory J. Strimbu
(74) *Attorney, Agent, or Firm*—Welsh & Katz, Ltd.

(57) ABSTRACT

An exterior door incorporates first and second overlays which extend laterally from the sides of the door so as to cover spaces between the door and the respective sides of the door frame. A third overlay can be attached to and extend across the top of the door, perpendicular to the overlays which extend along the sides of the door to cover the space between the top of the frame and the top of the door. The overlays frame, in part, the exterior surface of the door.

39 Claims, 5 Drawing Sheets

EXTERIOR DOOR WITH OVERLAYS FOR SEALING A GAP BETWEEN THE DOOR AND A DOORFRAME

FIELD OF THE INVENTION

The invention pertains to exterior doors. More particularly, the invention pertains to improved exterior doors which cover spaces between the door and an adjacent frame.

BACKGROUND OF THE INVENTION

Storm doors are often used in addition to a solid security door promote the comfort and enjoyment of a residence. In summer, such doors can be provided with a screen to facilitate the circulation of exterior air in and out of the residence. In winter, such doors can be provided with glass and thereby create a trapped volume of air between the doors for additional insulation. Additionally, when fitted with glass, storm doors make it possible to have an interior door open for an extended period of time without admitting cold exterior air into the residence.

Some forms of known storm doors are formed primarily of aluminum. Others incorporate a non-metallic core covered with aluminum sheet. Representative types of cores include particle board, plywood, solid wood and similar types of filler material.

Solid core doors provide improved insulation over aluminum doors. They also provide the advantage of a heavier more substantial door structure.

Such doors are usually hingedly supported in a frame which is in turn attached to a door opening in the residence. The frame usually has two spaced apart parallel sides and a top which connects the two sides. The frame defines a three sided door receiving region. The door is able to swing away from and into the frame on hinges. The door can be opened, rotated out of the frame, for ingress to and egress from the residence. Additionally, the door can be closed, rotated into the frame, and locked for security purposes.

To enable the door to rotate in and out of the door receiving region bounded by the frame, there must be enough space between the non-hinged rotating edge of the door and the adjacent side of the frame to allow the width of the door to rotate into the closed position in the frame. This space will be susceptible to both hot and cold breezes blowing against the door.

One known solution to sealing the space between the door and the frame is to use weatherstripping carried on the door, the frame or both. While effective for minimizing the flow of unwanted air through the space between the door and the frame, weatherstripping tends not to be a complete solution. As the weatherstripping ages, it loses some of its ability to block the inflow of exterior air.

It would be desirable to be able to block the inflow of exterior air through the spaces between the door and the frame with an exterior barrier. Preferably such a barrier could be not only cost effectively incorporated into the door but would also contribute to the overall appearance of the door both when the door is closed and when it is open. Additionally, it would be preferable if the barrier could be manufactured inexpensively and could be used on a variety of different doors.

SUMMARY OF THE INVENTION

An exterior door is rotatably carried in a frame. Spaces between the door and the frame enable the door to be rotated into and out of an internal region defined by the frame. The door can have a non-metallic core. Door cores can include one or more of foam, solid wood, wood composites, paper, plastic or, honeycombed paper, plastic or wood.

An overlay, or overlap, is attached to at least one edge of the door. The overlap, which could be molded or extruded plastic or metal, has a first curved section that curves away from the edge of the door, and, a second curved section which curves toward the frame.

The second curved section of the overlay extends, at least in part, over the adjacent space between the door and the frame. The overlay permits rotation of the door from the frame in a first direction; and opposite the first direction to the internal region. The overlay blocks continued rotation of the door in the first direction past the internal region.

In one embodiment, the door can carry first and second substantially identical, parallel overlays on spaced apart edges of the door. The door is rotatably attached to the frame by at least one hinge.

In one aspect, the frame is U-shaped with two elongated sides that extend parallel to and along the edges of the door with a space therebetween to permit rotation of the door. The sides are fixedly spaced apart from one another by an upper member that extends therebetween. The two sides and the upper member define a three-sided internal region.

The overlays may cover the hinges and the spaces between the door and the frame, at least in part. The presence of the overlays also reduces the ingress of external breezes into the spaces between the door and the frame.

In an embodiment, the overlays are formed of molded or extruded plastic, such as vinyl, or metal extrusions. Each extrusion has a door attachment section as well as a first section that curves away from the door and a second section that curves back toward the adjacent side of the frame.

In one embodiment, the attachment section is L-shaped. In another embodiment, the attachment section is U-shaped.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
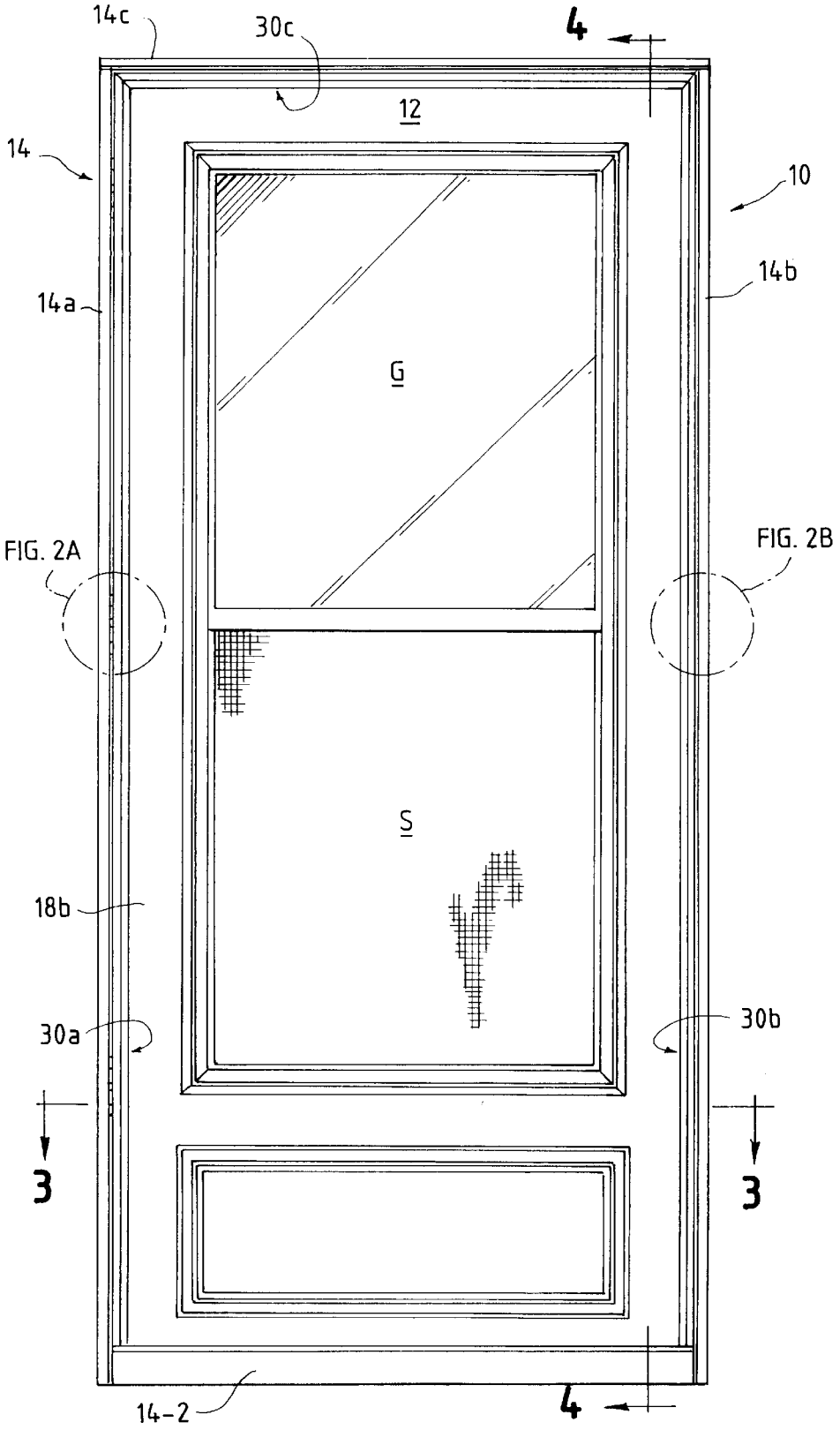
FIG. 1 is a front elevational view of a door/frame assembly in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a door/frame assembly 10 which carries wind blocking overlays in accordance with the present invention. The assembly 10 has an elongated rectangular door 12. Door 12 could be a storm door which incorporates one or more glass panels indicated generally at G. The door 12 could also incorporate one or more screen panels indicated generally at S.

Door 12 is rotatably mounted in a frame generally indicated at 14. Frame 14 is preferably formed of metal such as aluminum although use of a wooden frame would not depart from the spirit and scope of the present invention.

Frame 14 incorporates two elongated substantially parallel, spaced apart sides 14*a, b* and a perpendicular upper section 14*c* which joins the sides 14*a, b*. Taken together, the sections 14*a, b* and *c* bound a door receiving region R on three sides. The door 12 can be rotated from a closed position, indicated in FIG. 1, to an open position with one end extending away from the frame to permit ingress and egress from the residence.

FIGS. 2A, 2B, 3–4 illustrate additional details of the assembly 10. FIGS. 5A, B and 6 illustrate additional details of an overlay usable with the door 10.

Figure 3:
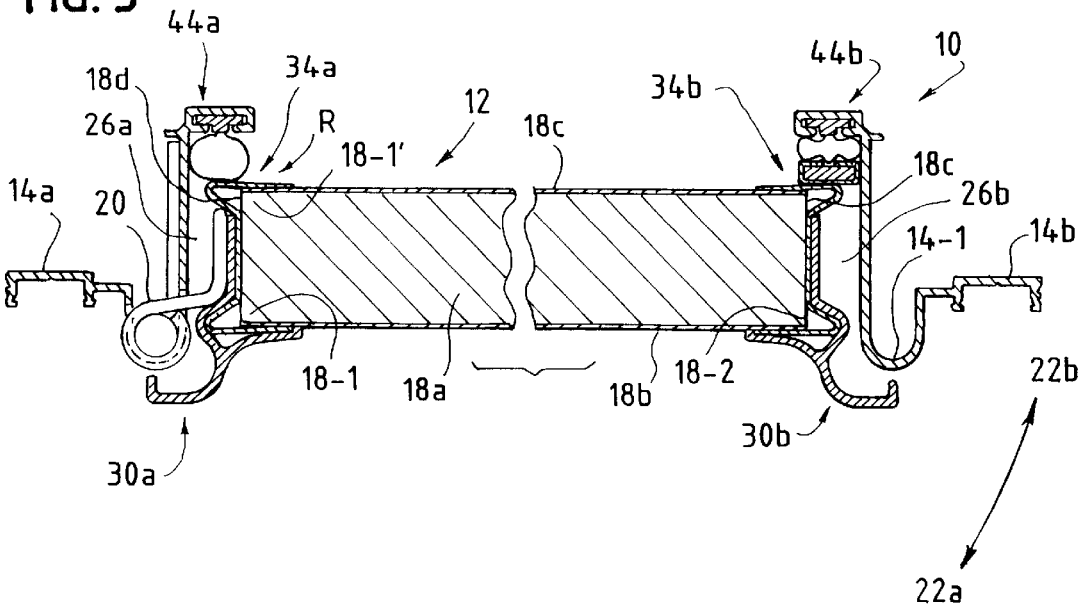
FIG. 3 is a sectional view taken along plane 3—3 of FIG. 1.
Figure 4:
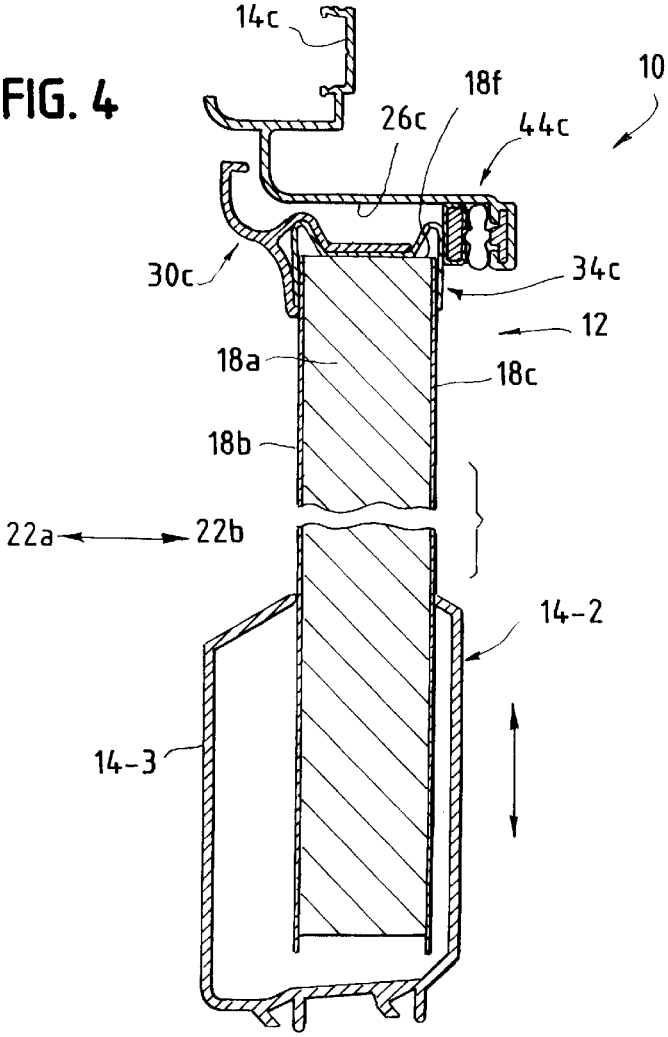
FIG. 4 is a sectional view taken along plane 4—4 of FIG. 1.
Figure 5A:
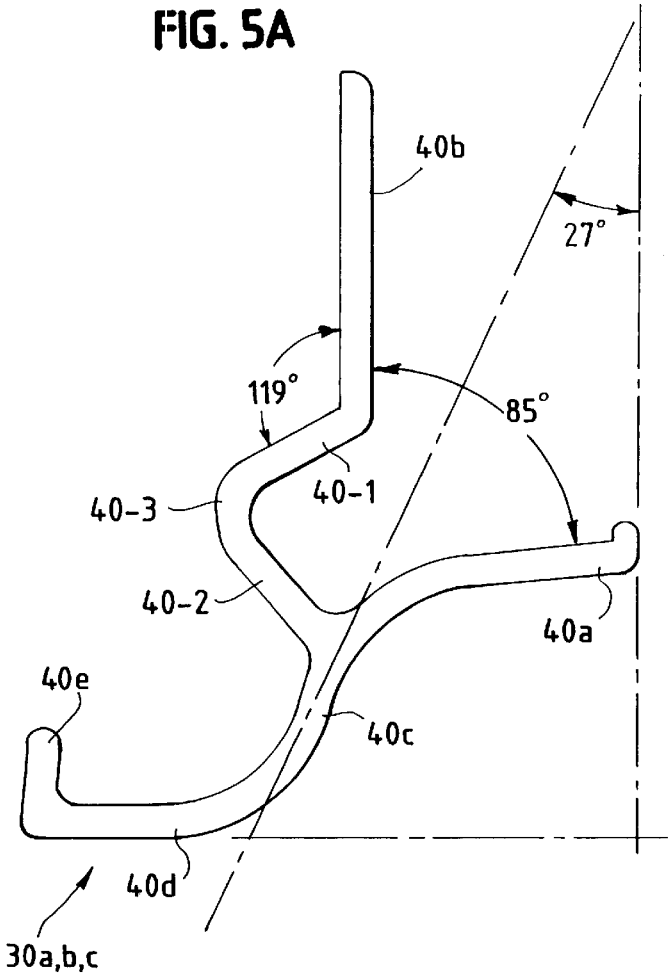
FIG. 5A is a top plan view of the overlay of FIG. 3 usable with the door/frame assembly of FIG. 1.
Figure 5B:
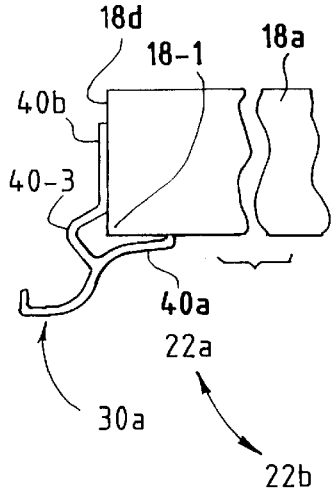
FIG. 5B is another top plan view, illustrating additional details of the overlay of FIG. 5A.
Figure 6:
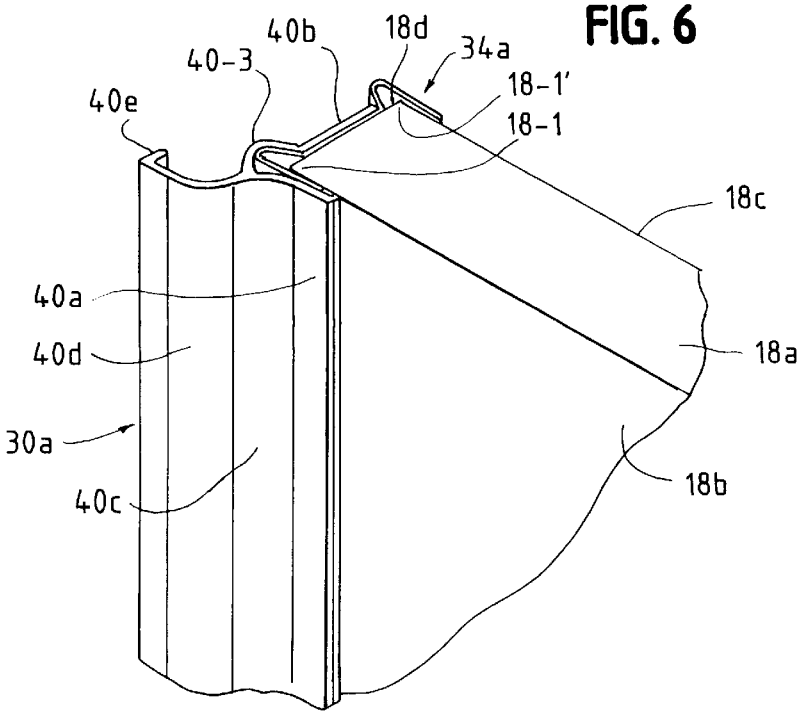
FIG. 6 is a fragmentary perspective view of the overlay of FIG. 5A mounted on a door as in FIG. 1.

The door 12 includes a core 18*a*, best seen in FIGS. 3 and 4, which is generally elongated and rectangular in accordance with the space provided by the frame 14. Core 18*a* is covered in an illustrated embodiment by metallic or plastic sheets 18*b*, 18*c*. As will be understood by those of skill in the art, the sheets 18*b* and 18*c* could be formed of aluminum which has been treated, such as being anodized or painted to exhibit different colors.

Figure 2A:
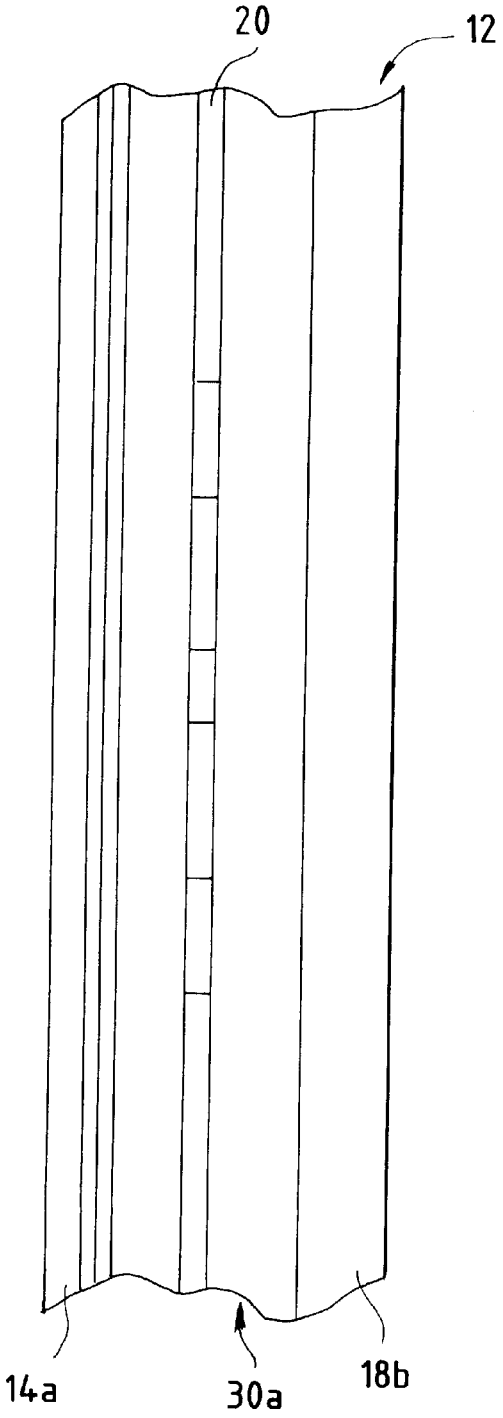
FIG. 2A is an enlarged fragmentary view of a part of the door/frame assembly of FIG. 1.
Figure 2B:
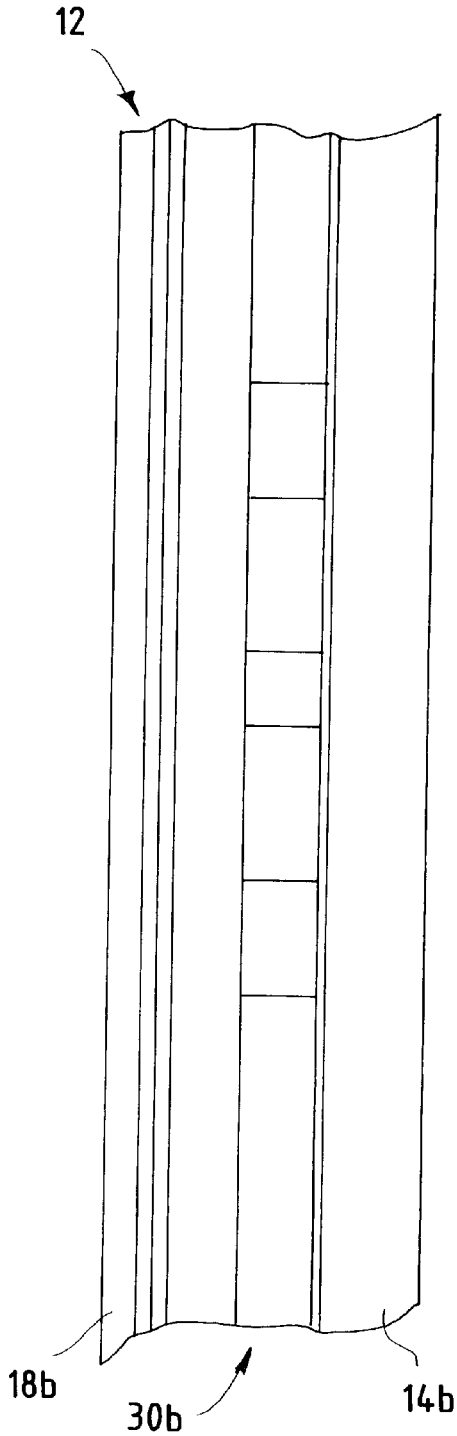
FIG. 2B is an enlarged partial fragmentary view of another part of the door frame assembly of FIG. 1.

The door 12 is rotatably attached to the frame 14 by a hinge 20, best seen in FIGS. 2A and 3. Hinge 20 permits door 12 to be rotated in a first direction, see FIG. 3, 22*a* away from frame 14 to an open state and in a second direction 22*b* back toward and into the frame 14.

As illustrated in FIG. 3, spaces 26*a* and 26*b* exist between adjacent portions of sides 14*a* and 14*b* of the frame and the door 12. Similarly, there is a space 26*c*, see FIG. 4, between door 12 and the top 14*c* of the frame. The spaces 26*a, b* and *c* facilitate rotary movement of the door 12 into and out of the door receiving region R formed by the three sides of the frame 14.

To block an inflow of exterior air through the spaces 26*a, b, c* as well as to optically cover those spaces, the door 12 carries first, second and third elongated, substantially identical overlays generally indicated at 30*a*, 30*b* and 30*c*. Overlays 30*a* and 30*b* extend parallel to one another along sides 18*d* and 18*e* of core 18*a*. Overlay 30*c* extends perpendicular to the overlays 30*a*, 30*b* along an upper or top edge 18*f* of core 18*a*.

Each of the overlays 30*a, b, c* could be attached directly to core 18*a*. Alternately, core 18*a* can be reinforced, best illustrated in FIGS. 3 and 4, by metallic reinforcing members such as the members 34*a*, 34*b* and 34*c*.

Each of the members 34*a*, 34*b*, 34*c* has a generally M-shaped cross section and could be formed of sheet steel. The reinforcing members 34*a*, 34*b*, 34*c* can be positioned between the respective overlays and the core 18*a*.

The assembly of the respective overlay, reinforcing member and core can be fastened together using screws or other types of fasteners as would be understood by those of skill in the art. It will also be understood that while the reinforcing members are illustrated in FIGS. 3 and 4 as having a generally M-shaped cross section, they in fact could be formed with just an L-shaped cross section without departing from the spirit and scope of the present invention. In such an embodiment, the L-shaped reinforcing element would underlie the attachment sections of the respective overlay, discussed subsequently.

FIG. 5A illustrates details of each of the overlays 30*a*, 30*b*, 30*c*. Each respective overlay includes first and second core abutting elements 40*a* and 40*b* each of which is elongated and is intended to abut either a portion of a reinforcing element, such as the element 34*a* or respective surfaces 18*b* and 18*d* in the absence of reinforcing element 34*a*.

Arcuately attached to element 40*a* is an element or extension section 40*c* which is curves or extends away from a corner 18-1 of core 18*a*, see FIG. 3. A second elongated section 40*d* arcuately extends back toward core 18*a* and an adjacent region of the respective frame member.

The second section 40*d* terminates in an end section 40*e* which is generally perpendicular to the section 40*d*. The end section 40*e* can be formed, if desired, at a 5° angle relatively to a line parallel to the element 40*b*. Elements 40*b* and 40*c* are joined by elements 40-1 and 40-2 which intersect in a region 40-3 displaced from the respective corner such as the corner, such as the corner 18-1 of the core 18*a*.

Thus, when the door 12 is closed against the frame 14, sections 40*d* of the respective overlay 30*a, b, c* extend over and cover the adjacent spaces between the door 12 and the frame 14 to improve the insulation characteristics thereof and also to hide the spaces between the door and the frame. As is illustrated in FIG. 3, the door 12 can rotate in the direction 22*a* away from the frame and in the direction 22*b* into the region R provided by the frame 14. The door 12 cannot rotate through the frame 14 at least for the reason that the section 40*d* of the overlay 30*b* extends horizontally, laterally, from the side of the door 12 effectively widening the door 12 such that section 14-1 of side 14*b* of the frame 14 blocks further movement of door 12 past the normally closed position. Similarly, section 40*d* of overlay 30*c* extends vertically, axially, from the top of the door 12 lengthening door 12 such that section 14-2 of the frame 14 blocks further movement of door 12 past the normally closed position.

It will be understood that the assembly 10 can incorporate weatherstripping and seals generally indicated at 44*a*, 44*b* and 44*c* if desired as would be understood by those of skill in the art without departing from the spirit and scope of the present invention. The presence or absence of additional insulating or weatherstripping material in the assembly 10 is not a limitation of the present invention.

For purposes of providing a height adjustment to the door 12, a slideably movable kick plate or threshold adjusting plate 14-2 can be mounted on a lower section of core 18*a*. The section 14-2 is movable vertically to adjust the height of the door 12 relative to the frame and the threshold.

The exemplary adjustment element 14-2 is formed with a laterally extending region 14-3 which in combination with the overlays 30*a, b, c* frames the exterior surface 18*b* of core 18*a*. This frame improves the appearance to the assembly 10 but is not a limitation of the present invention.

Figure 7A:
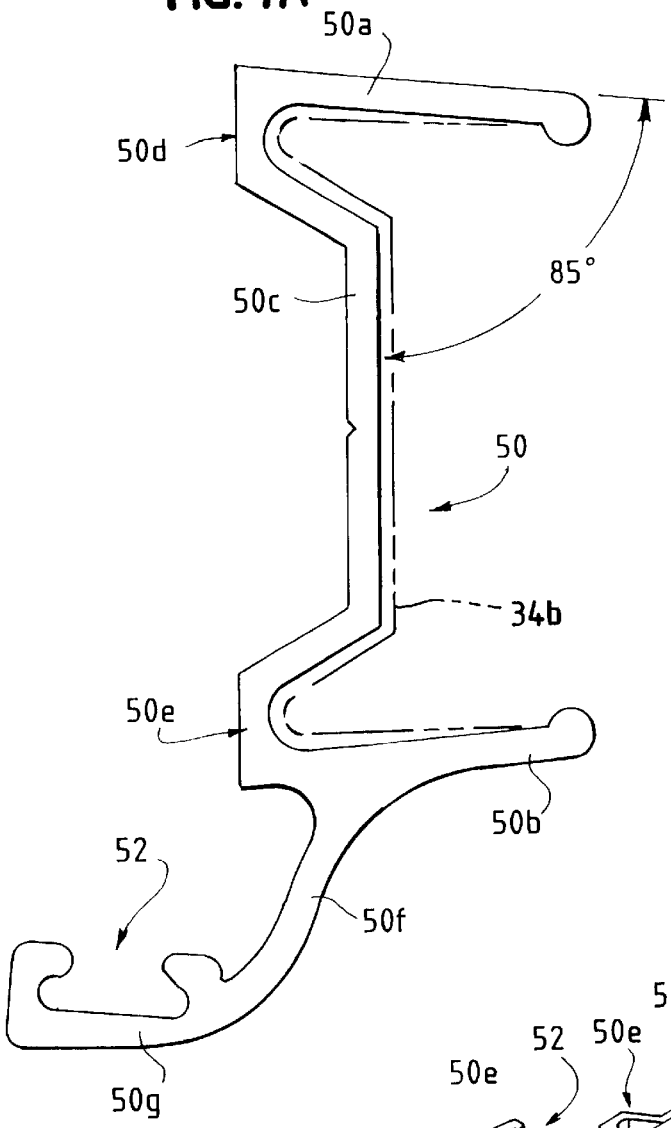
FIG. 7A is atop plan view of another overlay usable with the door/frame assembly of FIG. 1.
Figure 7B:
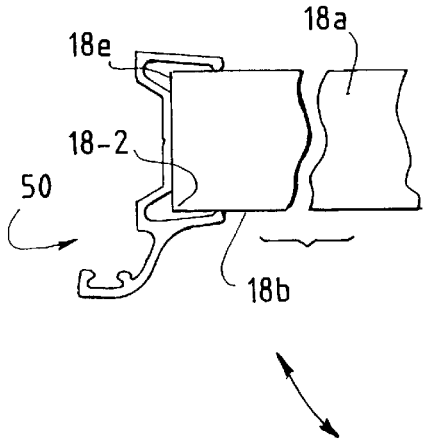
FIG. 7B is another top plan view illustrating additional details of the overlay of FIG. 7A.
Figure 8:
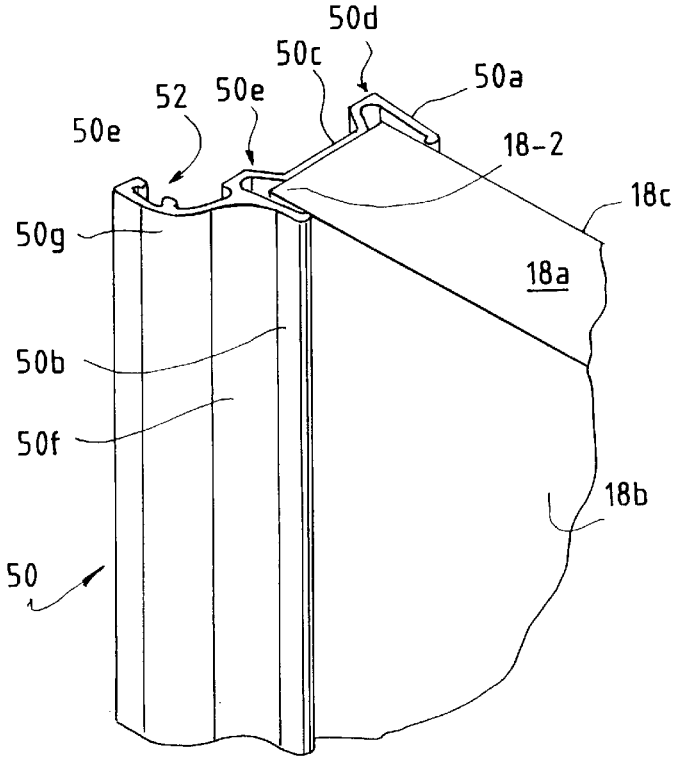
FIG. 8 is a fragmentary perspective view of the overlay of FIG. 7A mounted on a door as in FIG. 1.

FIGS. 7A, 7B and 8 illustrate an alternate form of an overlay 50 which can be mounted on three sides of core 18*a* as discussed with respect to overlays 30*a*, 30*b*, 30*c*. The overlay 50 includes first and second spaced apart elements 50*a* and 50*b* which are generally linear and extend at an angle toward one another, as would be understood by those of skill in the art, so as to slideably engage surfaces 18*b* and 18*c* of core 18*a*, best seen in FIG. 7B. The elements 50*a*, 50*b* are joined by an elongated planar central section 50*c*. Elements 50*a* and 50*c* are oriented at an angle on the order of 85 degrees with respect to one another.

Elements 50*a* and 50*c* are jointed at a protrusion 50*d*. The elements 50*b*, 50*c* are joined at a protrusion 50*e*.

Protrusions 50*d*, 50*e* are provided so that a reinforcing member such as the members 34*a*, 34*b* or 34*c* can be slid onto the end of core 18*a* and the overlay 50 can in turn be positioned over the respective reinforcing element. The reinforcing element is then trapped between the overlay 50 and the end of the core 18*a*. If desired, common screws could be used to attach all three parts to one another to form a rigid assembly.

The overlay 50 includes a curved member 50*f* which curves away from a corner such as corner 18-2 of core 18*a*. The overlay 50 also includes a second member 50*g* which extends from the member 50*f*. Member 50*g* curves back toward the core 18*a* and respective frame elements such as frame element 14*a, b, c*. Curved members 50*f* and 50*g* extend away from the core at an angle of about 22 to about 32 degrees with respect to the core and preferably at an angle of about 27 degrees. As discussed above, with respect to elements 40*c* and 40*d* the members 50*f*, 50*g* of overlay 50, when installed, cover the spaces between the door 12 and frame 14 thereby improving the insulating qualities of the assembly 10.

The overlays 30*a, b, c* and 50 can be formed as aluminum or plastic extrusions or moldings which can in turn be cut to length and assembled on the respective door 12. The overlay 50 can also carry a slotted region 52 which can be filled with weatherstripping as to further improve the insulating characteristics of the assembly 10.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A door comprising:

an elongated core with a selected width and a length and a pair of parallel, elongated sides;

at least one elongated, separate, non-symmetric overlay extending along one of the elongated sides of and attached to the core wherein the overlay has a core attachment section, the attachment section is adjacent to at least two surfaces of the core and includes curved, integrally formed first and second extension sections, the first extension section is coupled to the attachment section and has a first curvature, curving away from both the sides attachment section and the one of the elongated sides of the core, the second extension section extends from the first extension section and has an opposite curvature to the first curvature, the second extension section extends laterally from the core;

wherein an elongated, reinforcing member, formed of one of plastic and metal, extends along the one of the sides of the core between the core and the overlay;

wherein the reinforcing member has an M-shaped cross section.

2. A door as in claim 1 wherein the reinforcing member has at least one region which is spaced from a corner formed by the one side and one of the two surfaces.

3. A door as in claim 2 which carries at least one hinge attached to the one of the sides wherein the overlay covers the hinge at least in part.

4. A door as in claim 2 wherein the reinforcing member has another region which is spaced from the corner.

5. A door as in claim 4 wherein the overlay includes receiver spaces for the regions of the reinforcing member.

6. A door comprising:

an elongated core with a selected width and a length and a pair of parallel, elongated sides;

a first elongated, separate, non-symmetric overlay extending along one of the elongated sides of and attached to the core wherein the overlay has a core attachment section, the attachment section is adjacent to at least two surfaces of the core, and includes curved, integrally formed first and second extension sections, the first extension section is attached to the attachment section and has a first curvature, curving away from both the attachment section and the one of the elongated sides of the core, the second extension section extends from the first extension section and has an opposite curvature to the first curvature, the second extension section extends laterally from the core and includes a slot formed in a free distal end portion of said second extension section for mounting weather striping therein.

7. A door as in claim 6 wherein the core attachment section has first and second arms wherein the arms are substantially perpendicular to one another.

8. A door as in claim 7 wherein the arms form an L-shaped configuration.

9. A door as in claim 7 wherein the arms are joined at a protruding corner section.

10. A door as in claim 9 wherein the corner section extends from a respective corner of the core.

11. A door as in claim 10 wherein the corner section is displaced from the respective corner of the core.

12. A door as in claim 6, which includes a second elongated non-symmetric overlay extending along the other of the elongated sides of the core.

13. A door as in claim 12 hingedly attachable to a frame for rotation on an axis parallel to the elongated sides wherein the frame is for receiving the core but not the overlays therein.

14. A door as in claim 13 wherein the sides of the core are spaced from the frame when the door is in a closed position, and wherein the overlays cover the spaces, at least in part when the door is in the closed position.

15. A door in claim 6 wherein the second extension section terminates adjacent to the slot.

16. A door as in claim 15 wherein the core attachment section has first and second arms wherein the arms are substantially perpendicular to one another.

17. A door as in claim 16 wherein the arms form an L-shaped configuration.

18. A door as in claim 16 wherein the arms are joined at a protruding corner section.

19. A door as in claim 18 wherein the corner section extends from a respective corner of the core.

20. A door as in claim 19 wherein the corner section is displaced from the respective corner of the core.

21. A door as in claim 6 which includes a second overlay having a core attachment section and an extension section, and extending along the other side of the core each said overlay extends from the core thereby one of the surfaces of the core therebetween.

22. A door as in claim 21 wherein the core includes a third side, perpendicular to the pair of sides and which includes a third overlay having a core attachment section and an extension section, and extending along the third side, perpendicular to the first and second overlays wherein the three overlays frame the one of the surfaces along three sides thereof.

23. A door as in claim 22 wherein the core is covered at least in part, with one of a metal sheet and a plastic sheet.

24. A door as in claim 23 wherein the core is formed of at least one of foam, wood, wood composite, paper, plastic and metal.

25. A door as in claim 24 wherein the overlays cover, in part, the core covering sheet.

26. A door as in claim 25 wherein each of the core attachment sections includes a pair of legs oriented at an angle to one another.

27. A door as in claim 26 wherein the angle is about 85 degrees.

28. A door as in claim 26 wherein the extension sections of each said overlay are oriented at an angle in a range of about 22 to about 32 degrees with respect to the core.

29. A door as in claim 28 wherein the angle is about 27 degrees.

30. A door as in claim 28 wherein the overlays are each formed of at least one of metal and plastic.

31. A door as in claim 21 wherein the core is rotatably attachable to a frame which defines a core receiving region wherein the overlays cover spaces between the sides and the frame while the door is positioned in the core receiving region.

32. A door as in claim 6 wherein the attachment section in cross section, includes one a U-shaped portion and an L-shaped portion.

33. A door as in claim 6 wherein the attachment section comprises at least first and second legs wherein the legs are angled toward one another.

34. A door as in claim 6 which includes a reinforcement member located between the overlay and the core.

35. A door as in claim 6 which include a second overlay extending along the other of the elongated sides.

36. A door comprising:

a core having first and second planar surfaces bounded in part by first and second spaced apart sides;

an elongated overlay attached to the core and extending along one of the sides, the overlay has first and second legs angled toward one another, the legs are in contact with the core, the overlay includes a single elongated curved extension member having an opposing compound curve and attached to one of the legs, the extension member curves away from the core and has a free distal end portion wherein the overlay has an asymmetrical cross section and which includes a slot for weather stripping formed in the free distal end portion.

37. A door comprising:

an elongated core with a selected width and a length and a pair of parallel, elongated sides;

at least one elongated, separate, non-symmetric overlay extending along one of the sides of and attached to the core wherein the overlay has a core attachment section, the attachment section is adjacent to at least two surfaces of the core, and includes curved, integrally formed first and second extension sections, the first extension section is coupled to the attachment section and has a first curvature, curving away from both the attachment section and the one of the elongated sides of the core, the second extension section extends from the first extension section and has an opposite curvature to the first curvature, the second extension section extends laterally from the core;

a reinforcement member located between the overlay and the core; and wherein the reinforcement member has an M-shaped cross section and slidably engages the one of the elongated sides of the core.

38. A door comprising:

an elongated body with a pair of elongated spaced apart jambs;

at least a first, separate, overlay attached to the body along one of the jambs, the overlay includes first and second integrally formed, curved sections, the first and second curved sections each extend laterally relative to the body, and, the first curved section has a first curvature and the second curved section has a opposite curvature to the first curvature of the body, the second curved section is attached to the first curved section and wherein the first curved section is between the second curved section and the body; wherein the curved sections extend asymmetrically from the one of the jams of the body and wherein the overlay includes an elongated weather stripping slot at a distal free end portion of the second curved section.

39. A door as in claim 38 which includes a second overlay attached to the other of said jambs.

* * * * *